United States Patent [19]

Iijima et al.

[11] 4,344,392

[45] Aug. 17, 1982

[54] SPARK-IGNITION INTERNAL COMBUSTION ENGINE

[75] Inventors: Tamotsu Iijima; Yasuo Takagi, both of Yokohama, Japan

[73] Assignee: Nissan Motor Company, Limited, Kanagawa, Japan

[21] Appl. No.: 111,074

[22] Filed: Jan. 10, 1980

[30] Foreign Application Priority Data

Jan. 18, 1979 [JP] Japan ..... 54-545890[U]

[51] Int. Cl.[3] ..... F02N 11/08

[52] U.S. Cl. ..... 123/179 G; 123/187.5 R; 123/179 A

[58] Field of Search ..... 123/179 G, 179 L, 179 A, 123/187.5 R

[56] References Cited

U.S. PATENT DOCUMENTS

| | | | |
|---|---|---|---|
| 3,125,084 | 3/1964 | Hall | 123/179 G |
| 3,562,542 | 2/1971 | Redmond | 123/179 A |
| 3,614,945 | 10/1971 | Schlagmuller et al. | 123/179 G |
| 3,827,417 | 8/1974 | Morita | 123/187.5 R |
| 3,888,223 | 6/1975 | Mondt | 123/187.5 R |
| 4,117,821 | 10/1978 | Kawai | 123/179 G |

*Primary Examiner*—P. S. Lall

*Attorney, Agent, or Firm*—Lowe, King, Price & Becker

[57] ABSTRACT

In a spark-ignition internal combustion engine, during low engine temperature or battery voltage, additional fuel is introduced into the mixture supply system of the engine and, following a predetermined time delay, the cranking motor of the engine is actuated to start the engine.

16 Claims, 5 Drawing Figures

SPARK-IGNITION INTERNAL COMBUSTION ENGINE

FIELD OF THE INVENTION

The present invention relates in general to starting systems for internal combustion engines and, more particularly, to a starting system for an automotive spark-ignition internal combustion engine that injects additional fuel into the engine upon starting during predetermined engine conditions such as low engine temperature or low battery voltage.

BACKGROUND OF THE INVENTION

As is well known in the art, the starting performance of a spark-ignition internal combustion engine tends to be impaired when the engine is operating cold or when the voltage being delivered from the battery forming part of the ignition system of the engine is low.

When the engine is operating cold, the riser portion of the intake manifold of the engine is maintained at a low temperature so that the fuel passed through the riser portion cannot be gasified satisfactorily and is, as a consequence, admitted to the power cylinders of the engine largely in a liquid or emulsified state. For this reason, the gaseous-phase air-to-fuel ratio, viz., the air-to-fuel ratio of the air/fuel mixture which lends itself to combustion in the power cylnders of the engine becomes higher than that of the mixture which is to be produced by the fuel and air actually supplied to the power cylinders. If the gaseous-phase air-to-fuel ratio of the mixture fed to the combustion chambers of the engine is thus higher than air-to-fuel ratios of a combustible range, the mixture fails to be ignited properly and cannot be combusted effectively.

The fuel admitted into each combustion chamber of the engine is gasified in an increasing proportion as the compression stroke of the power cylinder proceeds. The gasifying rate of the fuel in the combustion chamber of the engine notably varies with the velocity of movement of the piston in the power cylinder and accordingly with the output speed of the cranking motor during starting of the engine. If, therefore, the voltage supplied to the cranking motor from the battery of the ignition system of the engine is reduced to a low level so that the cranking motor cannot operate at sufficiently high revolution speeds, the fuel in the combustion chambers of the engine cannot be gasified at satisfactory rates during the compression stroke of the power cylinder. This also results in an increase in the gaseous-phase air-to-fuel ratio of the mixture to contribute to the combustion in the power cylinders and causes improper burning of the mixture in the combustion chambers of the engine.

It is, on the other hand, known to those skilled in the art that the gaseous-phase air-to-fuel mixture in a combustion chamber of a spark-ignition internal combustion engine can be reduced if fuel is supplied to the power cylinder at an increased rate even though the fuel supplied to the combustion chamber is gasified in a limited proportion. This is because an increase in the rate of supply of fuel to a combustion chamber results in an increase in the quantity of the fuel gasified in the combustion chamber. If, therefore, fuel is supplied to the power cylinders of the engine at an increased rate during cranking of the engine, the mixture to contribute to the combustion in the power cylinders will be ignited properly and will accordingly provide an improved cranking performance.

It has therefore been put into practice to suck in fuel into the intake manifold of an internal combustion engine when the choke valve of the engine is in a closed condition during cranking of the engine. Such an expedient is, however, not fully acceptable because the vacuum developed in the intake manifold of the engine is not so high (in absolute value) as to be capable of sucking fuel into the intake manifold at a sufficiently high rate during cranking of the engine when the engine is operating at low speeds. Therefore, the riser portion of the intake manifold of the engine flows in a liquid of emulsified state in the intake manifold and takes a substantial amount of time to reach the combustion chambers of the engine. For this reason, the fuel sucked into the intake manifold during cranking of the engine cannot be gasified rapidly with the result that the air/fuel mixture delivered to the combustion chambers of the engine cannot be enriched enough to significantly improve the cranking performance of the engine.

The present invention contemplates overcoming the above described drawback of a conventional spark-ignition internal combustion engine for automotive use.

SUMMARY OF THE INVENTION

In accordance with the present invention, there is provided a spark-ignition combustion engine including an air/fuel mixture supply system having a main fuel delivery circuit incorporated therein and an electrically-operated cranking device which is operative to crank the engine to start when actuated. Of particular importance, an auxiliary fuel delivery circuit is open into the mixture supply system, and an electrically-operated valve is operative to control the delivery rate of fuel through the auxiliary fuel delivery circuit. An electric control circuit intervenes between the cranking device and the aforesaid valve and is responsive to variation in at least one preslected operational parameter of the engine to actuate the valve and thereafter the cranking device when said operational parameter satisfies a predetermined condition during cranking of the engine. The control circuit may comprise a starter switch electrically connected between the cranking motor and a power source, a main control switch electrically connected between the power source and the above mentioned valve across the starter switch, a delay circuit which is electrically connected between the cranking motor and the aforesaid power source across the starter switch, and an auxiliary control switch which is connected in shunt across the delay circuit and which is operative conversely to the main control switch in response to the above mentioned preselected operational parameter.

In one preferred embodiment of the present invention, the main and auxiliary control switches forming part of the above described control circuit are constituted by main and auxiliary temperature-sensitive switches, rspectively, each of which is responsive to variation in the temperature to effect the performance of the engine. In this instance, the main control or temperature-sensitive switch is operative to close in response to temperatures lower than a predetermined value and the auxiliary control or temperature-sensitive switch is operative to be open in response to temperatures lower than the predetermined value.

In another preferred embodiment of the present invention, each of the main and auxiliary control switches of the above described control circuit is responsive to variation in the voltage to be supplied from the aforesaid power source. In this instance, the main control switch is operative to close when the voltage supplied from the power source is lower than a predetermined value and the auxiliary control switch is operative when the voltage supplied from the power source is lower than the predetermined value.

If desired, each of the respective main control switches and each of the auxiliary control switches in the two preferred embodiments may be connected in parallel with each other.

Still other objects and advantages of the present invention will become readily apparent to those skilled in this art from the following detailed description, wherein we have shown and described the preferred embodiments of the invention, simply by way of illustration of the best modes contemplated by us of carrying out our invention. As will be realized, the invention is capable of other and different embodiments, and its several details are capable of modification in various, obvious respects, all without departing from the invention. Accordingly, the drawings and description are to be regarded as illustrative in nature, and not as restrictive.

BRIEF DESCRIPTION OF THE DRAWINGS

The features and advantages of a spark-ignition internal combustion engine according to the present invention will be more clearly appreciated from the following description taken in conjunction with the accompanying drawings in which.

FURTHER DESCRIPTION OF THE PRIOR ART

Figure 1:
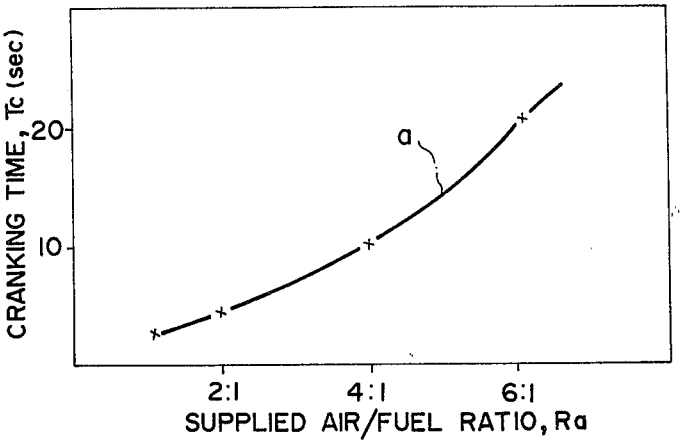
FIG. 1 is a graph showing an example of the relationship between the air-to-fuel ratio of a combustible mixture supplied to the power cylinders of a spark-ignition internal combustion engine and the period of time required for the cranking of the engine.

As previously discussed, the period of time required for the cranking of an internal combustion engine increases and the cranking performance of the engine becomes the worse as the air/fuel mixture supplied to the engine during cranking becomes the leaner, viz., the air-to-fuel ratio of the mixture increases. Such a tendency of an internal combustion engine is graphically demonstrated in FIG. 1 in which curve a indicates the relationship between the ratio Ra between the rates at which air and fuel (normal hexane) are supplied from the intake manifold of an internal combustion engine to the power cylinders of the engine during cranking of the engine and the period of time Tc required to crank the engine to start.

Figure 2:
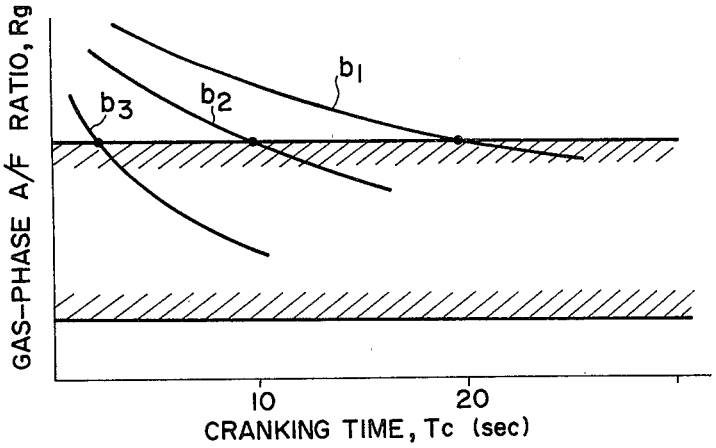
FIG. 2 is a graph showing examples of the cranking time and the gaseous-phase air-to-fuel ratio in a spark-ignition internal combustion engine.

Although the cranking time Tc increases as the air/fuel mixture supplied to the power cylinders of an internal combustion engine becomes leaner, the gaseous-phase air-to-fuel ratio of the mixture contributing to the combustion in the power cylinders can be reduced (viz., the mixture can be enriched) if fuel is supplied to the power cylinders at an increased rate even though the proportion of the gasified fuel to the mixture supplied may be limited. This is graphically demonstrated in FIG. 2 in which curves $b_1$, $b_2$ and $b_3$ show examples of the relationship between the cranking time Tc and the gaseous-phase air-to-fuel ratio Rg achieved when an air/fuel mixture is supplied to the power cylinders of an engine at different rates which increases in accordance with the sequence of the curves $b_1$, $b_2$ and $b_3$. In the graph of FIG. 2, the partially hatched area indicates the range of the air-to-fuel ratio of the mixtures which are combustible. The curves $b_1$, $b_2$ and $b_3$ thus demonstrate that the cranking time Tc can be reduced and accordingly the cranking performance of a spark-ignition internal combustion engine can be signicantly improved when fuel is supplied to the power cylinders of the engine at an increased rate during cranking of the engine.

DESCRIPTION OF THE PREFERRED EMBODIMENTS

Figure 3:
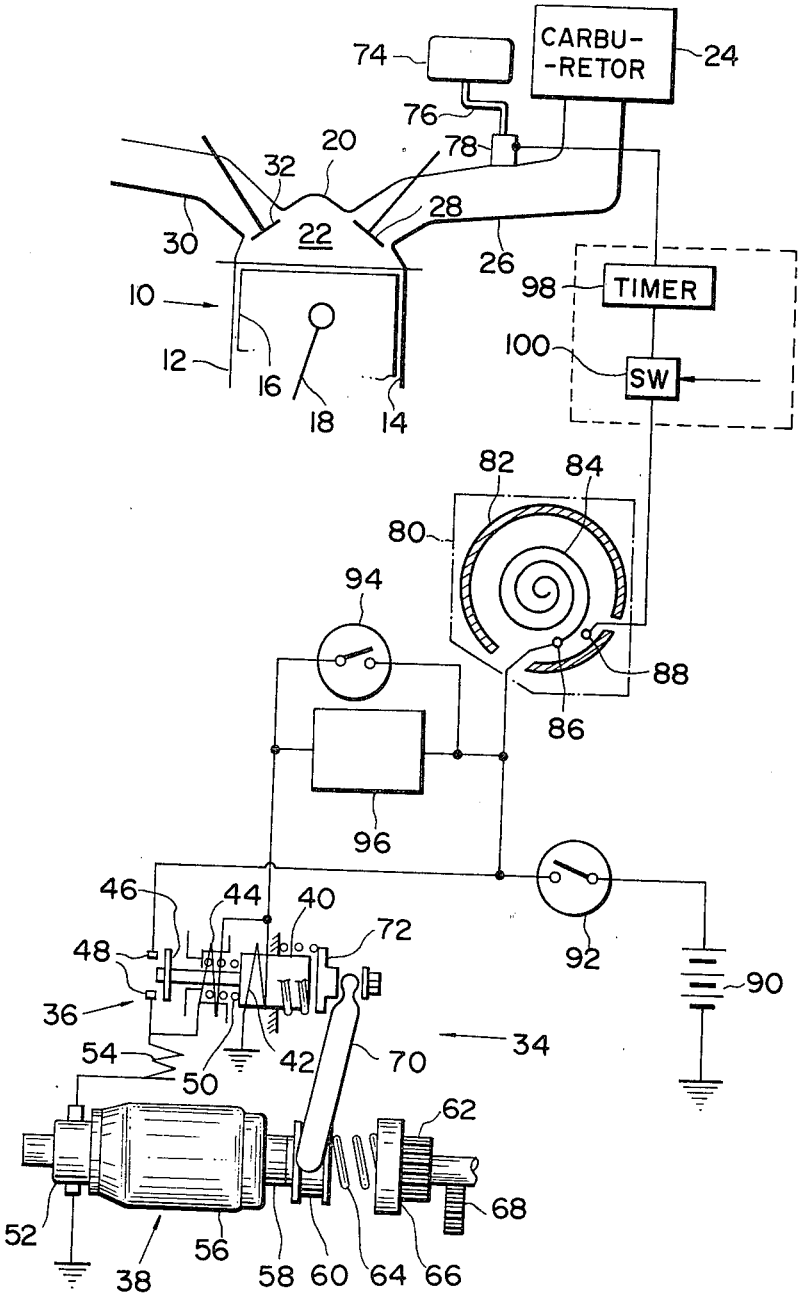
FIG. 3 is a schematic view showing a preferred embodiment of the spark-ignition internal combustion engine according to the present invention.

In FIG. 3, a spark-ignition internal combustion engine embodying the present invention comprises a plurality of power cylinders which are represented by a power cylinder 10 have a cylinder block 12 formed with a cylinder bore 14. A reciprocating piston 16 is axially movable back and forth in the cylinder bore 14 and is coupled to an engine crankshaft (not shown) by a connecting rod 18. The cylinder block 12 is topped by a cylinder head 20 defining a variable-volume combustion chamber 22 between the cylinder head 20 and the upper face of the reciprocating piston 16.

The internal combustion engine shown in FIG. 3 further comprises a mixture supply system which is assumed, by way of example, to consist of a carburetor 24 and an intake manifold 26 leading from the carburetor 24 to the power cylinders 10 of the engine. The intake manifold 26 has a riser portion merging into a plurality of runner portions which respectively terminate in the respective intake ports of the individual power cylinders across intake valves which are represented by an intake valve 28. Though not shown in FIG. 3, the carburetor 24 includes a main fuel delivery circuit which is open into the ventura of the carburetor 24.

The internal combustion engine shown in FIG. 3 further comprises an exhaust system including an exhaust manifold 30 leading from the respective exhaust ports of the individual power cylinders of the engine across exhaust valves which are represented by an exhaust valve 32.

In FIG. 3, the internal combustion engine embodying the present invention is further shown comprising a cranking motor 34 which largely consists of a stationary field unit 36 and a rotating armature unit 38 as is customary. The stationary field unit 36 comprises a movable core plunger 40 and a parallel combination of a hold-in or shunt coil 42 and a pull-in or series coil 44 which are wound on the core plunger 40. The core plunger 40 is connected to a movable contact 46 which is movable into and out of contact with a pair of stationary contacts 48. The core plunger 40 is biased by a spring 50 to move in a direction to have the movable contact 46 spaced apart from the stationary contacts 48 shown. On the other hand, the rotating armature unit 38 comprises a commutator 52 connected through a field coil 54 to the pull-in coil 44 and one of the stationary contacts 48 of the field unit 36, an armature (not shown) enclosed in a yoke 56, and an armature shaft 58 projecting from the yoke 56 in a direction opposite to the commutator 52. The armature shaft 58 has mounted thereon a sleeve 60 having flanges at both axial ends thereof and axially slidable on the shaft 58. The sleeve 60 is connected to a drive pinion 66 by means of a pinion spring 58 and across an overrunning clutch 66. The pinion assembly thus including the sleeve 60, drive pinion 62, pinion spring 64 and overruning clutch 66 is axially movable into and out of a position having the drive pinion 62 held in mesh with a ring gear 68 attached to the flywheel (not shown) on the output shaft of the engine or the torque converter drive plate.

The field and armature units 36 and 38 are coupled together by a shift lever 70 which is engaged at one end by the sleeve 60 of the armature unit 38 and a shift lever retainer 72 connected to the core plunger 40 of the field unit 36. The shift lever 70 has an intermediate portion pivotally connected to a suitable stationary structural member (not shown) of the engine so that the sleeve 58 of the armature unit 38 is moved into a position having the drive pinion 66 engaged by the ring gear 68 when the core plunger 40 is forced to move in a direction to cause the movable contact 46 to contact the stationary contacts 48 with the hold-in and pull-in coils 42 and 44 energized.

In accordance with the present invention, the internal combustion engine thus constructed and arranged further comprises an auxiliary fuel delivery circuit including a source 74 of fuel under pressure, and a fuel feed passageway 76 leading from the fuel source 74 and terminating in an electrically-operated fuel injection valve 78 projecting into the intake manifold 26 of the engine. The fuel injection valve 78 is actuated by signals delivered from an electric control circuit which is arranged in conjunction with the above described cranking motor 34 and which comprises a main temperature-sensitive switch 80 is responsive to the atmospheric temperature or the temperature of, for example, the cooling medium to be circulated through the cooling circuit (not shown) of the engine. In the embodiment herein shown, the temperature-sensitive switch 80 is assumed to be arranged to be responsive to the temperature of the cooling water for the engine and comprises a casing 82 located in the cooling water jacket (not shown) of the engine and a spiral bimetal element 84 which is adapted to be deformed when subjected to heat. The bimetal element 84 has at its outer end a movable contact 86 which is movable, by deformation of the bimetal element 84, into and out of contact with a stationary contact element 88. The movable and stationary contacts 86 and 88 are arranged so that the contacts are brought into contact with each other when the bimetal element 84 is subjected to a temperature lower than a predetermined value. The temperature-sensitive switch 80 is, thus, of the normally-open type and is operative to close when the temperature detected by the switch 80 is lower than the predetermined value. One of the contacts 86 and 88 such as the stationary contact 88 is connected to the electric actuating element (not shown) of the fuel injection valve 78 and the other of the contacts 86 and 88 such as the movable contact 86 is connected to a d.c. power source 90 across a normally-open switch 92. The power source 90 may be constituted by the battery forming part of the ignition system of the engine, while the normally-open switch 92 is constituted by a starter switch which intervenes between the battery 90 and one of the stationary contacts 48 of the field unit 36 of the cranking motor 34. The other of the stationary contacts 48 of the field unit 36 is connected through the field coil 54 to one of the brushes forming part of the commutator 52 of the armature unit 38 of the cranking motor, the other of the brushes being grounded.

The control circuit of the embodiment shown in FIG. 3 further comprises a parallel combination of an auxiliary temperature-sensitive switch 94 and a delay circuit 96 which are connected in parallel between the starter switch 92 and hold-in and pull-in coils 42 and 44 of the field unit 36 of the cranking motor 34 as shown. The auxiliary temperature-sensitive switch 94 is arranged to operate oppositely to the main switch 80 and is, thus, operative to be open and closed when the main temperature-sensitive switch 80 is closed and open, respectively. The auxiliary temperature-sensitive switch 94 having such a function may be constituted by a normally-closed bimetallic switch or may be mechanically ganged to the bimetal element 84 or the movable contact 86 of the main temperature-sensitive switch 80. As an alternative, the auxiliary temperature-sensitive switch 94 may be constituted by a normally-closed relay having a relay coil connected in series with the movable contact 86 of the main temperature-sensitive switch 80 though not shown in the drawings.

When, now, the temperature detected by the main and auxiliary temperature-sensitive switches 80 and 94 is lower than a predetermined value, the main temperature-sensitive switch 80 is held closed and the auxiliary temperature-sensitive switch 94 is held open. When the starter switch 92 is closed under these conditions, the electric actuating element of the fuel injection valve 78 provided in the intake manifold 26 of the engine is connected to the battery 90 through the movable and stationary contacts 86 and 88 of the main temperature-sensitive switch 80 and across the starter switch 92. The fuel injection valve 78 is therefore actuated to inject fuel into the intake manifold 26 and increases the gaseous-phase air-to-fuel ratio of the air/fuel mixture in the intake manifold 26 or the combustion chambers 22 of the power cylinders 10 of the engine.

For a predetermined period of time after the starter switch 92 has been closed, the delay circuit 96 is maintained in a non-conductive state so that the hold-in and pull-in coils 42 and 44 of the field unit 36 of the cranking motor 34 are disconnected from the battery 90 with the auxiliary temperature-sensitive switch 94 held open. The cranking motor 34 is therefore maintained inoperative for some time after the starter switch 92 is closed. Upon lapse of the predetermined period of time after the starter switch 92 has been closed, the delay circuit 96 becomes conductive and energizes the hold-in and pull-in coils 42 and 44 of the fuel unit 36 of the cranking motor 34, which is accordingly made operative to drive the ring gear 68 and accordingly the output shaft of the engine. By the time the cranking motor 34 is actuated to operate, the gaseous-phase air-to-fuel ratio of the mixture supplied to the combustion chambers 22 of the power cylinders 10 of the engine has been increased to a combustible range by the delivery of fuel from the auxiliary fuel injection valve 78 into the intake manifold 26 of the engine. The initial explosion thus takes place in each of the power cylinders 10 at an early stage after the cranking motor 34 has been actuated to operate.

When the temperature detected by each of the main and auxiliary temperature-sensitive switches 80 and 94 is lower than the predetermined value, the main temperature-sensitive switch 80 is held open and the auxiliary temperature-sensitive switch 94 is kept closed. Under these conditions, the auxiliary fuel injection valve 78 is maintained inoperative and the hold-in and pull-in coils 42 and 44 of the field unit 36 of the cranking motor 34 are energized from the battery 90 through the auxiliary temperature-sensitive switch 94 bypassing the delay circuit 96 immediately when the starter switch 92 is closed. When the temperature in the engine is at relatively high levels and accordingly the fuel introduced into the mixture supply system of the engine can be readily gasified, the engine is thus cranked by the cranking motor 34 immediately when the starter motor switch 92 is closed.

If desired, a timing circuit 98 may be connected between the main temperature-sensitive switch 80 and the electric actuating element of the fuel injection valve 78 so that the period of time for which the fuel injection valve 78 is in operation can be varied depending upon certain operational conditions such as the operating temperature of the engine. Likewise, the delay circuit 96 may be constructed and arranged so that the delay time of the circuit 96 is variable depending upon certain operational conditions such as the operating temperature of the engine so as to preclude excessive retardation of the actuation of the cranking motor 34.

Furthermore, a suitable switch 100 responsive to fouling of the ignition spark plugs (not shown) in the power cylinders 10 may be connected in series with the above described timing circuit 98. The fouling of an ignition spark plug is a phenomenon in which fuel is deposited on the electrodes of the spark plug and forms a short circuit between the electrodes. When fouling takes place on an ignition spark plug, the spark plug fails to spark over and accordingly ignite the combustible mixture in the combustion chamber. The 100 switch is responsive to such a phenomenon and is operative to open in response to an occurrence of the fouling on the spark plug in any of the power cylinders. The switch 100 is thus effective to disconnect the fuel injection valve 78 from the battery 90 and interrupt the delivery of fuel from the valve 78 into the intake manifold 26 in the event fouling is caused on the spark plug in any of the power cylinders 10.

Figure 4:
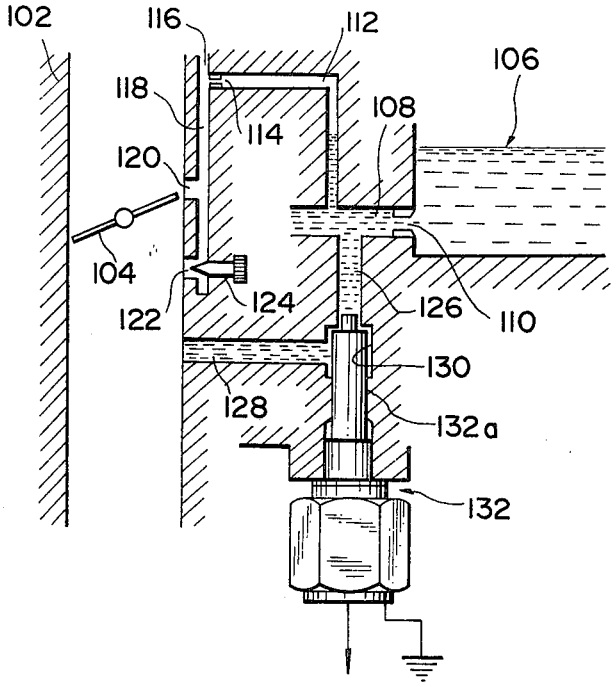
FIG. 4 is a schematic sectional view showing part of another preferred embodiment of the spark-ignition internal combustion engine according to the present invention.

The fuel source 74 and the fuel feed passageway 76 constituting the auxiliary fuel delivery circuit in the embodiment hereinbefore described with reference to FIG. 3 are arranged independently of the main fuel delivery circuit included in the carburetor 24. The auxiliary fuel delivery circuit of the spark-ignition internal combustion engine according to the present invention may, however, be arranged in conjunction with the main fuel delivery circuit of the carburetor 24 if desired. FIG. 4 shows part of such a modified embodiment of the present invention.

Referring to FIG. 4 the carburetor 24 is shown comprising a mixture induction pipe 102 leading to the intake manifold of the engine and having a throttle valve 104 provided downstream of a venturi (not shown). The carburetor 24 further comprises main and low-speed fuel delivery circuits which originate in a carburetor float bowl 106. As is well known in the art, the carburetor float bowl 106 is in communication with a fuel storage tank (not shown) of the engine and has stored therein the liquid fuel pumped from the storage tank. The main fuel delivery circuit comprises a fuel feed passageway 108 leading from the bottom of the float bowl 106 through a main fuel metering jet 110. The fuel feed passageway 108 is branched into a branch passageway 112 which terminates through an orifice 114 into a main fuel discharge passageway 116 which is open into the venturi in the mixture induction pipe 102 of the carburetor 24. On the other hand, the low-speed fuel delivery circuit comprises a low-speed fuel discharge passageway 118 leading from the branch passageway 112 through the orifice 114 and open into the mixture induction pipe 102 through a low-speed fuel discharge port 120 and an idle fuel discharge port 122. The low-speed fuel discharge port 120 is located to be open in proximity to an edge portion of the throttle valve 104 in an idling or minimum-open position thereof as shown, while the idle fuel discharge port 122 is located to be open downstream of the throttle valve 104. The flow rate of the fuel to be injected into the mixture induction pipe 102 through the idle fuel discharge port 122 is adjustable by the use of an idle adjustment screw 124 having a needle valve portion projecting into the port 122. The above described general arrangement of the main and low-speed fuel delivery circuits is merely illustrative of the fuel circuit arrangement of an ordinary carburetor and is subject to modification and change.

In the embodiment illustrated in FIG. 4, the carburetor 24 is further provided with an auxiliary fuel delivery circuit including an auxiliary branch passageway 126 leading from the main fuel feed passageway 108 and an auxiliary fuel discharge passageway 128 which is open into the mixture induction pipe 102 downstream of the throttle valve 104. Between the auxiliary branch passageway 106 and the auxiliary fuel discharge passageway 108 is formed a valve chamber 130 into which a movable valve element **132*a* of an electrically-operated two-position fuel cut-off valve 132 axially projects as shown. The fuel cut-off valve 132 has an electric actuating element which is connected to a d.c. power source across a control circuit constructed and arranged similarly to its counterpart in the embodiment illustrated in FIG. 3. It will thus be apparent that the embodiment of FIG. 4 is operable essentially similarly to the embodiment of FIG. 3**.

Figure 5:
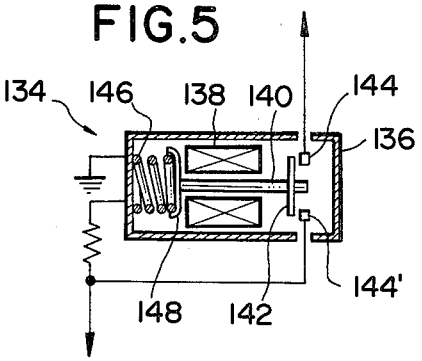
FIG. 5 is a sectional view showing an alternative example of the switch means forming part of the embodiment illustrated in FIG. 3.

FIG. 5 shows a voltage-sensitive switch 134 which may be used in lieu of the temperature-sensitive switch 80 in the control circuit of the embodiment illustrated in FIG. 3. The voltage-sensitive switch 134 comprises a generally cylindrical casing 136 having fixedly enclosed therein a cylindrical solenoid coil unit 138 and an elongated core plunger 140 which is axially movable through the bore in the coil unit 138. The core plunger 140 has at one end thereof a movable contact 142 which is movable into and out of a pair of stationary contacts 144 and 144' which are fixedly held in position with respect to the casing 136. One of the stationary contacts 144 and 144' is connected to the actuating element of the fuel injection valve 78 (FIG. 3) and the other of the contacts 144 and 144' is connected in parallel with one lead wire of the solenoid coil unit 138 to a d.c. power source across a suitable normally-open switch such as for example a starter switch, similarly to the contacts 86 and 88 of the temperature-sensitive switch 80 in the embodiment illustrated in FIG. 3. The other lead wire of the solenoid coil unit 138 is connected to ground.

The core plunger 140 is axially urged in a direction to have the movable contact 142 in contact with the stationary contacts 144 and 144' by suitable biasing means which is shown comprising a preloaded helical compression spring 146 seated at one end on the inner face of one end wall of the casing 136 and at the other end on a spring seat plate 148 attached to the core plunger 140.

The construction and arrangement of the voltage-sensitive switch 134 above described correspond to those of the main temperature-sensitive switch 80 in the embodiment of FIG. 3. A voltage-sensitive switch for use as an alternative of the auxiliary temperature-sensitive switch 94 in the embodiment illustrated in FIG. 3 may thus be constructed and arranged in such a manner that the counterpart of the core plunger 140 is biased to move away from an axial position having the movable contact 142 spaced apart from the stationary contacts 144 and 144' and is caused to move toward such an axial position as the voltage supplied from the battery 92 drops.

When, in operation, the switch such as the starter switch intervening between the voltage-sensitive switch 134 and the d.c. power source is closed, the solenoid coil unit 138 is electrically connected to the power source and urges the core plunger 140 to axially move in a direction causing the movable contact 142 to be spaced apart from the stationary contacts 144 and 144' against the force of the compression spring 146 in the voltage-sensitive switch 134. If, there, the voltage supplied from the d.c. power source to the solenoid coil unit 138 is higher than a certain value which will be largely determined by the number of turns of the coil unit 138 and the force of the spring 146, the movable contact 142 on the core plunger 140 is kept isolated from the stationary contacts 144 and 144' so that the actuating element of the auxiliary fuel injection valve 78 (FIG. 3) is maintained de-energized. As the voltage supplied to the solenoid coil unit 138 drops, the magnetic field induced by the coil unit 138 declines and permits the core plunger 140 to axially move in a direction to cause the movable contact 142 to approach the stationary contacts 144 and 144' by the force of the spring 146. When the voltage supplied to the solenoid coil unit 138 is reduced below the above mentioned certain value, the movable contact 140 on the core plunger 140 is brought into contact with the stationary contacts 144 and 144' and establishes a closed loop through the d.c. power source and the actuating element of the fuel injection valve 78 (FIG. 3), causing the fuel injection valve 78 to delivery additional fuel into the intake manifold of the engine.

The air/fuel mixture to be supplied to the power cylinders of the engine is, thus, enriched and the actuation of the cranking motor is retarded upon closure of the starter switch if the voltage supplied from the power source for the starter motor is at a relatively low level during cranking of the engine, as in the embodiment described with reference to FIG. 3.

While a few preferred embodiments of the present invention have thus far been described, such embodiments are merely illustrative of the subject matter of the present invention and, therefore, may be modified and/or changed if desired. For example, the embodiment of FIG. 3 may be modified in such a manner that a voltage-sensitive switch of the natures described with reference to FIG. 5 is connected in parallel with each of the main and auxiliary temperature-sensitive switches 80 and 94.

While, furthermore, the present invention has been described as being embodied in an internal combustion engine of the type using a carburetor as the mixture supply system of the engine, it will be apparent that the subject matter of the present invention is applicable not only to such an engine but to a spark-ignition internal combustion engine of the fuel injection type.

What is claimed is:

1. A fuel supply system for a spark-ignition internal combustion engine comprising:

a primary mixture supply system including a primary fuel delivery circuit;

an electrically-operated cranking device operative to crank the engine to start when actuated;

an auxiliary mixture supply system including an auxiliary fuel delivery circuit which has one end opening into said primary mixture supply system;

an electrically operated valve provided in said auxiliary fuel delivery circuit for controlling delivery rate of the auxiliary fuel through said auxiliary fuel delivery circuit; and an electric control circuit responsive to at least one preselected operational parameter of the engine during starting for actuating said valve and thereafter, following a predetermined time delay, actuating said cranking device to start the engine, said control circuit including a starter switch electrically connected between said cranking device and a power source, a main control switch electrically connected between said valve and said power source across said starter switch and responsive to said preselected parameter, a delay circuit electrically connected between said cranking device and said power source across said starter switch, and an auxiliary control switch connected in shunt across said delay circuit and operative conversely to said main control switch in response to said preselected operational parameter.

2. A fuel supply system for a spark-ignition internal combustion engine as set forth in claim 1, wherein said main and auxiliary control switches are constituted by main and auxiliary temperature-sensitive switches, respectively, each of which is responsive to variation in the temperature to affect the performance of the engine and wherein the main control switch is operative to close in response to temperatures lower than a predetermined value and said auxiliary control switch is operative to be open in response to temperatures lower than said predetermined value.

3. A fuel supply system for a spark-ignition internal combustion engine as set forth in claim 1, wherein each of said main and auxiliary control switches is responsive to variation in the voltage to be supplied from said power source and wherein the main control switch is operative to be close when the voltage from said power source is lower than a predetermined value and the auxiliary control switch is operative to be open when the voltage from the power source is lower than said predetermined value.

4. A fuel supply system for a spark-ignition internal combustion engine as set forth in claim 3, wherein the improvement further comprises a main temperature-sensitive switch connected in parallel with said main control switch and an auxiliary temperature-sensitive switch connected in parallel with said auxiliary control switch and wherein each of the main and auxiliary temperature-sensitive switches is responsive to variation in the temperature to effect the performance of the engine, the main temperature-sensitive switch being operative to close in response to temperatures lower than a predetermined value and the auxiliary temperature-sensitive switch being operative to be open is response to temperatures lower than said predetermined value of the temperature.

5. A fuel supply system for a spark-ignition internal combustion engine as set forth in claim 2 or 4, wherein each of said main and auxiliary temperature-sensitive switches comprises a stationary solenoid coil unit electrically connected between said power source and each of said valve and said cranking motor across said starter switch, a core plunger operative to contact with said coil unit, a stationary contact on said core plunger, and a pair of stationary contacts one of which is electrically connected to said power source across said starter switch and the other of which is electrically connected to each of said valve and said cranking motor, said core plunger being movable into and out of a position having said movable contact held in contact with said stationary contacts.

6. A fuel supply system for a spark-ignition internal combustion engine as set forth in claim 5, wherein said main temperature-sensitive switch further comprises biasing means urging said core plunger to move toward said position thereof and is arranged so that the core plunger is moved away from said position thereof as the voltage supplied to said coil unit increases and wherein said auxiliary temperature-sensitive switch further comprises biasing means urging said core plunger to move away from said position thereof and is arranged so that the core plunger thereof is moved toward said position thereof as the voltage supplied to the coil unit of the auxiliary temperature-sensitive switch increases.

7. A fuel supply system for a spark-ignition internal combustion engine as set forth in any one of claims 1 or 2 or 3 or 4, wherein said auxiliary fuel delivery circuit is arranged independently of said main fuel delivery circuit.

8. A fuel supply system for a spark-ignition internal combustion engine as set forth in claim 7, wherein said mixture supply system comprises a carburetor having said main fuel delivery circuit incorporated therein and an intake manifold leading from the carburetor and wherein said auxiliary fuel delivery circuit is open into said intake manifold across said valve.

9. A fuel supply system for a spark-ignition internal combustion engine as set forth in claim 8, wherein said mixture supply system comprises a carburetor and wherein said main and auxiliary fuel delivery circuits are included in the carburetor.

10. A fuel supply system for a spark-ignition internal combustion engine as set forth in any one of claims 1 or 2 or 3 or 4, wherein said auxiliary fuel delivery circuit is branched from said main fuel delivery circuit.

11. A fuel supply control system for a spark-ignition internal combustion engine comprising:

a primary mixture supply system having a main fuel delivery circuit incorporated therein;

an electrically-operated cranking device operative to crank the engine to start when actuated;

an auxiliary mixture supply system incorporating an auxiliary fuel delivery circuit which has one end opening into said primary mixture supply system;

an electrically-operated valve provided in said auxiliary fuel delivery circuit for controlling the delivery rate of fuel through said auxiliary fuel delivery circuit;

a starter switch electrically connected between said cranking device and a power source;

a main control switch electrically connected between said valve and said power source across said starter switch and responsive to the temperature to affect the performance of the engine, said main control switch being constituted by a main temperature-sensitive switch which is operative to close in response to temperature lower than a predetermined value, said main temperature-sensitive switch including a stationary solenoid coil unit electrically connected between said power source and each of said valve and said cranking device across said starter switch, a core plunger operative to contact with said coil unit, a movable contact on said core plunger which is movable into and out of a position having said movable contact held in contact with said stationary contacts, a pair of stationary contacts one of which is electrically connected to said power source across said starter switch and the other of which is electrically connected to each of said valve and said cranking device and biasing means urging said core plunger to move toward said position thereof and arranged so that the core plunger is moved away from said position thereof as the voltage supplied to said coil unit increases;

a delay circuit electrically connected between said cranking device and said power source across said starter switch; and an auxiliary control switch connected in shunt across said delay circuit and operative conversely to said main control switch in response to said temperature, said auxiliary control switch being constituted by an auxiliary temperature-sensitive switch which is operative to close in response to temperature lower than a predetermined value, said auxiliary temperature-sensitive switch including a stationary solenoid coil unit electrically connected between said power source and each of said valve and said cranking device across said starter switch, a core plunger operative to contact with said coil unit, a movable contact on said core plunger which is movable into and out of a position having said movable contact held in contact with said stationary contacts, a pair of stationary contacts one of which is electrically connected to said power source across said starter switch and the other of which is electrically connected to each of said valve and said cranking device and biasing means urging said core plunger to move away from said position thereof and arranged so that the core plunger is moved toward said position thereof as the voltage supplied to said coil unit increases.

12. A fuel supply system for a spark-ignition internal combustion engine as set forth in claim 11, wherein each of said main and auxiliary control switches is responsive to variation in the voltage to be supplied from said power source and wherein the main control switch is operative to be closed when the voltage from said power source is lower than a predetermined value and the auxiliary control switch is operative to be open when the voltage from the power source is lower than said predetermined value.

13. A fuel supply system for a spark-ignition internal combustion engine as set forth in any one of claims 11 or 12, wherein said auxiliary fuel delivery circuit is arranged independently of said main fuel delivery circuit.

14. A fuel supply system for a spark-ignition internal combustion engine as set forth in claim 13, wherein said mixture supply system comprises a carburetor having said main fuel delivery circuit incorporated therein and an intake manifold leading from the carburetor and wherein said auxiliary fuel delivery circuit is open into said intake manifold across said valve.

15. A fuel supply system for a spark-ignition internal combustion engine as set forth in claim 14, wherein said mixture supply system comprises a carburetor and wherein said main and auxiliary fuel delivery circuits are included in the carburetor.

16. A fuel supply system for a spark-ignition internal combustion engine as set forth in claim 11 or 12, wherein said auxiliary fuel delivery circuit is branched from said main fuel delivery circuit.

* * * * *